United States Patent [19]

Dolan

[11] Patent Number: 4,789,102

[45] Date of Patent: Dec. 6, 1988

[54] SQUEEZE SPRAY HEAD

[76] Inventor: John E. Dolan, 15 New Main St., Haverstraw, N.Y. 10927

[21] Appl. No.: 53,807

[22] Filed: May 26, 1987

[51] Int. Cl.[4] ..... B05B 11/04

[52] U.S. Cl. ..... 239/327

[58] Field of Search ..... 239/327; 222/543, 211, 222/212

[56] References Cited

U.S. PATENT DOCUMENTS

| | | | |
|---|---|---|---|
| 3,341,130 | 9/1967 | Weber | 239/327 |
| 3,679,137 | 7/1972 | Marchant | 239/327 |
| 4,024,992 | 5/1977 | Schmid | 239/327 |
| 4,286,735 | 9/1981 | Sneider | 239/327 |

FOREIGN PATENT DOCUMENTS

| | | | |
|---|---|---|---|
| 1209968 | 1/1966 | Fed. Rep. of Germany | 239/327 |

*Primary Examiner*—Andres Kashnikow
*Assistant Examiner*—Michael J. Forman
*Attorney, Agent, or Firm*—John F. Ohlandt

[57] ABSTRACT

A squeeze spray container includes a spray head with a nozzle part and an air intake part. A slotted membrane seated in the air intake part prevents air from escaping the container when squeezed, and causes a positive pressure to be applied to liquid in the container so as to direct the liquid up a liquid feed tube received in the nozzle part. The nozzle part is generally cylindrical and has an air passage formed in its inside wall to communicate pressurized air from a bottom end to a top end of the nozzle part when the container is squeezed. A spray passage in the top end communicates between the air passage and a liquid spray opening in the nozzle part, and a first liquid notch in the inside surface of the top end directs pressurized liquid forced up the feed tube to a point in the spray passage at which pressurized air is directed by the air passage. Accordingly, a pressurized mixture of air and liquid is forced through the spray passage and exits the nozzle spray opening in a liquid spray pattern.

4 Claims, 1 Drawing Sheet

SQUEEZE SPRAY HEAD

BACKGROUND OF THE INVENTION

1. Field Of The Invention

The present invention relates generally to squeeze spray containers, and more particularly to a spray head which includes both a nozzle part and an air intake part.

2. Background Information

Liquid sprayer heads are known from U.S. Pat. Nos. 3,701,478 issued Oct. 31, 1972, and 3,749,290 issued July 31, 1973.

The sprayer of the U.S. Pat. No. 3,701,478 is of a fairly complex construction and includes a pivoted handle which, when squeezed, causes a piston ring to urge liquid contained in a cylinder out of a nozzle. When the handle is released, liquid is drawn up a tube, through a valve and into the liquid cylinder.

The U.S. Pat. No. 3,749,290 discloses a trigger actuated pump wherein after liquid rises through a dip tube, past a check valve and into a pump chamber, squeezing of the trigger compresses the pump chamber to force the liquid past an outlet valve to discharge through a nozzle.

It will be appreciated that the sprayer heads of the mentioned patents must rely either on a spring member (i.e., U.S. Pat. No. 3,701,478 or a natural resiliency of material forming a liquid chamber (i.e., the U.S. Pat. No. 3,749,290) to draw liquid in a container up a liquid delivery tube and past a check valve mechanism to assure a sufficient supply of the liquid in the cylinder or pump chamber. That, coupled with the requirement for a number of operating parts and valve mechanisms which must be formed to close tolerances, make the mentioned hand operated sprayer heads undesirable particularly from a cost standpoint.

SUMMARY OF THE INVENTION

An object of the invention is to provide a squeeze spray head made from a minimum number of parts but nevertheless possessing a high degree of reliability.

Another object of the invention is to provide a squeeze spray head which does not require a separate trigger or handle for operation.

In attempts that have been made to obviate the need for separate triggers or handles for operation of spray type containers, the spray caps or heads have been deficient in not allowing the container to return immediately to its original shape. This is because air must enter the container through the same opening in the conventional cap or head from which the liquid is sprayed.

Accordingly, a further object of the invention is to provide a squeeze spray head which is operated simply by squeezing of an associated container, but in which air can enter the container, at the proper time, by a different opening from the spray opening.

Another object of the invention is to provide a squeeze spray head which requires but a single check valve mechanism.

According to the invention, a squeeze spray container includes a resiliently deformable container having a top opening, and a spray head adapted to fit the top opening of the container, the spray head including a nozzle part and an air intake part. A check valve mechanism, or means, associated with the air intake part prevents air in the container from escaping when the container is squeezed, and causes a positive pressure to be applied to liquid in the container. The same mechanism allows outside air to enter the container when the container is released to expand. A liquid feed tube is fitted at one end to the nozzle part, and extends into the container to direct pressurized liquid to the nozzle part when the spray head is fitted and the container is squeezed.

The nozzle part has a generally cylindrical wall with a closed top end and an open bottom end in which the liquid feed tube is received. A first air passage is formed in the inside wall to pass pressurized air between the bottom end and the top end of the nozzle part when the container is squeezed. The top end has a first spray passage communicating between the first air passage and a liquid spray opening in the nozzle part, and a first liquid groove in the inside surface of the top end directs pressurized liquid from the feed tube to a point in the first spray passage at which the pressurized air is directed by the first air passage. Accordingly, a pressurized mixture of air and liquid is forced through the spray passage to exit the liquid spray opening in a spray pattern when the container is squeezed.

The various features of novelty which characterize the invention are pointed out with particularity in the claims annexed hereto and forming a part of the present disclosure. For a better understanding of the invention, its operating advantages and specific objects attained by its use, reference should be had to the accompanying drawing and descriptive matter in which there is illustrated and described a preferred embodiment of the invention.

DETAILED DESCRIPTION OF THE INVENTION

Figure 1:
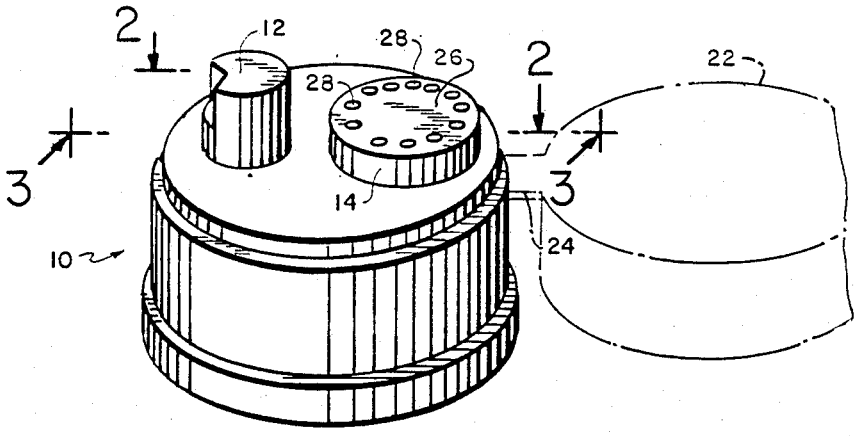
FIG. 1 is an overall perspective view of a spray head for a squeeze spray container according to the invention.
Figure 2:
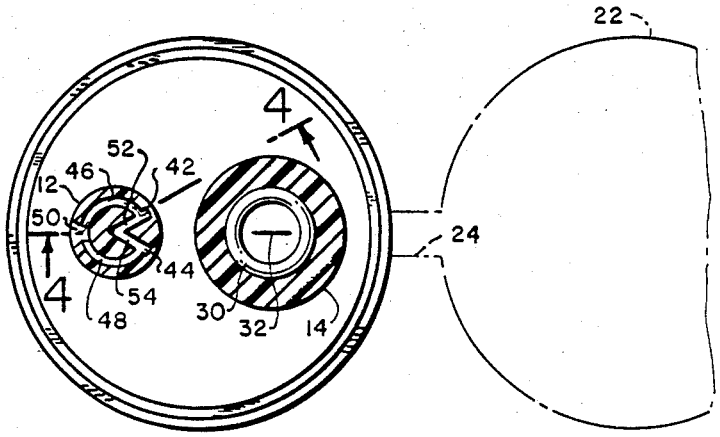
FIG. 2 is a sectional view of the spray head as taken along line 2—2 in FIG. 1.
Figure 3:
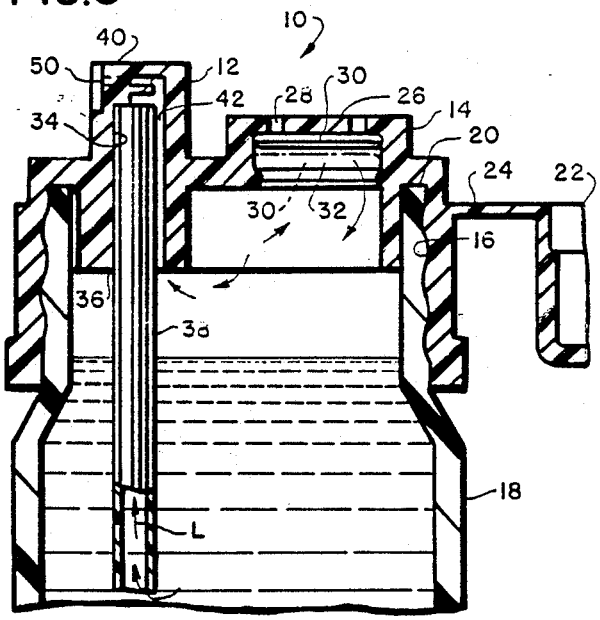
FIG. 3 is a sectional view of the spray head as taken along line 3—3 in FIG. 1, and showing an upper part of an associated container and a liquid feed tube.

FIGS. 1 and 2 are views of a spray head 10 including a nozzle part 12 and and air intake part 14 according to the invention. In the disclosed embodiment, the spray head 10 is in the form of a cylindrical container cap with interior threads 16 as shown in FIG. 3. Threads 16 are provided for fitting the cap onto an associated resiliently deformable container 18, at a correspondingly threaded top opening 20 of the container 18.

The spray head 10 is formed preferably of a moldable plastics material such as polypropylene. A spray head cover 22 which may be formed of the same material and molded together with the spray head 10, is hinged at 24 to the outer circumference of the spray head 10. Accordingly, the cover 22 can be swung and snap fitted on the spray head 10 to conceal the nozzle part 12 and the air intake part 14.

The intake part 14 includes a cap 26 with a number of perforations 28. The interior of the cap 26 is formed to seat a flexible disk membrane 30 having a slot 32. The slot 32 in the membrane 30, and the perforations 28 in the cap 26 of the air intake part 14, are dimensioned and arranged so that when air pressure is applied to the underside of the membrane 30 as when the container 18 is squeezed, the membrane 30 is urged upwardly in air tight relation against the inside surface of the cap 26 (FIG. 3). When the container 18 is released and allowed to expand, however, the membrane 30 drops down to its normal seated position as also illustrated (in phantom). Accordingly, air from outside the container 18 and spray head 10 is allowed to enter the container 18 through the cap perforations 28 and thence through the membrane slot 32.

Figure 4:
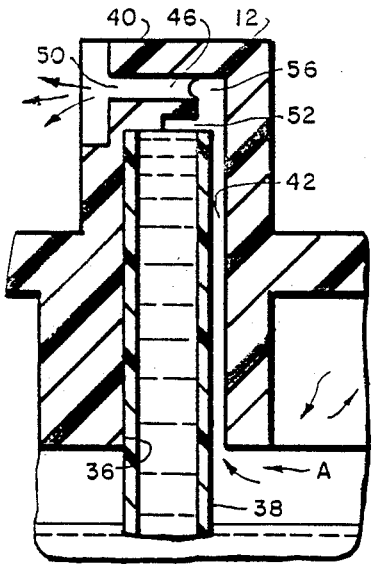
FIG. 4 is an enlarged sectional view of a nozzle part of the spray head, as taken along line 4—4 in FIG. 2.

The nozzle part 12 has a generally cyindrical wall 33 defining a chamber 34 as indicated in FIGS. 3 and 4. Because of the open end 36 provided in chamber 34, the nozzle part 12 is adapted to receive, in tight fitting relation, one end of a liquid feed tube 38, such tube being extended fully into chamber 34. The liquid feed tube 38 also extends into the container 18 to direct pressurized liquid at the other end of the tube (not shown) to a closed top end 40 of the nozzle part 12 when the spray head 10 is fitted to the container 18 and the container is squeezed. Arrow L in FIG. 3 represents the direction of liquid flow.

A first air passage 42 and a second air passage 44 extend parallel to one another in the wall 33 of the nozzle part 12, along the direction of the axis of the wall 33. The air passages 42, 44 communicate pressurized air as represented by the arrow A in FIG. 4 between the bottom end and the top end of the nozzle part 12 when the container 18 is squeezed.

The nozzle part 12 also has a first spray passage 46 and a second spray passage 48 which together define a circular arc passage (FIG. 2), the mid point of which coincides with a liquid spray opening 50 in the nozzle part 12.

A first liquid notch 52 and a second liquid notch 54 are formed in the inside surface of the top end 40 of the nozzle part 12 as represented in FIG. 2. These notches 52 and 54 are optimally dimensioned to have a width of 0.040 inches and a depth of 0.125 inches. The notches are divergent at an angle of approximately 60 degrees, resulting in a spray pattern of 120 degrees. Each of the liquid notches 52, 54 extends radially in the inside surface of the nozzle part top end 40 to communicate with open ends of the circular arc passage formed by the first spray passage 46 and second spray passage 48. An open end 56 of the first spray passage 46 is shown in FIG. 4. Further, as shown in FIG. 4, the first air passage 42 directs pressurized air to the open end 56 of the first spray passage 46, so that pressurized liquid supplied by the feed tube 38 to the first liquid notch 52, mixes with the pressurized air supplied through the first air passage 42, and the pressurized mixture is forced through the open end 56 of the first spray passage 46 to exit through the nozzle part opening 50 in a spray pattern S when the container 18 is squeezed.

Likewise, pressurized air and liquid mix in the second liquid notch 54 and the mixture is forced through the second spray passage 48 and out of the nozzle opening 50 when the container 18 is squeezed.

When the container 18 is released, air enters the container through the perforations 28 in the cap 26 of the air intake part 14, and the slot 32 in the flexible membrane 30 as discussed above. Air will enter the container rapidly to replace that which was exhausted after squeezing of the container. The present invention thus overcomes a major problem with some of the conventional spray caps or spray heads, wherein a relatively long period of time is required, after squeezing of a container, to induct air and allow the container to return to its original shape. Such problem arose due to the fact that the prior spray caps or heads required the air to enter the container through the same opening in which liquid is sprayed out. With the squeeze spray head of the present invention, however, the membrane 30 of rubber or similar material allows air to enter the container 18 rapidly and, thus, overcomes the mentioned problem with some of the prior constructions. In addition, the membrane 30 which is closed when the container 18 is squeezed, does not allow air inside the container 18 to escape through the membrane slot 32 or cap perforations 28. This increases pressure applied to the liquid L going up the feed tube 38 which liquid then mixes with the pressurized air A directed through the first and second air passages 42, 44. A finer spray pattern S results.

While the foregoing description respresents a preferred embodiment of the invention, it will be obvious to those skilled in the art that various changes and modifications may be made, without departing from the true spirit and scope of the invention.

I claim:

1. A squeeze spray container comprising:

a resiliently deformable container for holding a liquid to be sprayed, the container having a top opening;

a spray head adapted to fit said container in liquid sealing relation at said top opening, for producing a liquid spray in a given direction when the container is squeezed, said spray head including a nozzle part and an air intake part;

check valve means associated with said air intake part for preventing, when the container is squeezed, air in said container from escaping and for causing a positive pressure to be applied to liquid in the container, and for allowing outside air to enter the container when the container expands; and a liquid feed tube fitted at one end to communicate with said nozzle part, said tube extending into said container to direct pressurized liquid at the other end of the tube to said nozzle part when the spray head is fitted to the container;

wherein said nozzle has a generally cylindrical wall with a closed top end and an open bottom end for receiving said one end of the liquid feed tube, including first and second air passages formed in the wall to communicate pressurized air between the bottom end and the top end of the nozzle part when the container is squeezed, said top end having first and second spray passages which communicate respectively between said first and second air passages and a liquid spray opening in said nozzle part; and first and second liquid notches extending in a V-configuration in the inside surface of said top end for directing pressurized liquid developed at said one end of said feed tube to an end point in said first and second spray passages at which pressurized air is directed by said first and second air passages, so that a pressurized mixture of air and liquid is forced through such first and second spray passages and exits the liquid spray opening in a spray pattern when said container is squeezed.

2. A squeeze spray container as defined in claim 1, in which said first and second spray passages together define a circular arc passage, the midpoint of which coincides with said liquid spray opening.

3. A squeeze spray container according to claim 1, wherein said check valve means comprises a flexible membrane having a slot, and said air intake part includes a perforated cap and means for seating said membrane so that when the container is squeezed, said membrane is urged in airtight relation against the inside surface of said cap.

4. A squeeze spray container according to claim 1, including a cover hinged on said spray head for swinging over and snap fitting on said spray head to conceal said nozzle and said air intake part.

* * * * *